United States Patent [19]

Clardy et al.

[11] Patent Number: 4,871,302

[45] Date of Patent: Oct. 3, 1989

[54] APPARATUS FOR REMOVING FLUID FROM THE GROUND AND METHOD FOR SAME

[75] Inventors: T. J. Clardy, Seguin; Henry Meno, Arlington, both of Tex.

[73] Assignee: Milam/Clardy, Inc., San Antonio, Tex.

[21] Appl. No.: 148,777

[22] Filed: Jan. 26, 1988

[51] Int. Cl.[4] ..... F04B 47/08

[52] U.S. Cl. ..... 417/404; 91/306; 91/313

[58] Field of Search ..... 417/404, 403, 397, 393; 91/306, 305, 313

[56] References Cited

U.S. PATENT DOCUMENTS

| | | | |
|---|---|---|---|
| 1,066,483 | 7/1913 | Fournia | 91/306 |
| 1,833,778 | 11/1931 | Fletcher . | |
| 2,119,736 | 6/1938 | Coberly | 417/404 |
| 2,366,777 | 1/1945 | Farley et al. . | |
| 2,631,541 | 3/1953 | Dempsey . | |
| 2,712,302 | 7/1955 | Zoller . | |
| 2,843,046 | 7/1958 | Knowles . | |
| 2,943,576 | 7/1960 | English . | |
| 3,093,122 | 6/1963 | Sachnik . | |
| 4,068,983 | 1/1978 | Balme . | |
| 4,406,598 | 9/1983 | Walling | 417/404 |
| 4,544,335 | 9/1985 | Roeder . | |

OTHER PUBLICATIONS

Specification for the Kobe Hydraulic Bottom Hole Piston Pumps (author unknown, date unknown).

*Primary Examiner*—Leonard E. Smith

*Attorney, Agent, or Firm*—Gunn, Lee & Miller

[57] ABSTRACT

A piston-driven down hole pump and a method for using the same to lift fluid on both its upstroke and downstroke. The pump is powered by a waste water injection pump. A drive piston connected to a production piston and three-way valve power the down hole pump through the steady flow of the power fluid from the injection pump. The power fluid is exhausted into the well annulus and rises to the surface comingled with the fluid.

10 Claims, 4 Drawing Sheets

APPARATUS FOR REMOVING FLUID FROM THE GROUND AND METHOD FOR SAME

FIELD OF THE INVENTION

The present invention relates to a down hole, hydraulically activated piston pump for removing a fluid from a well, and a method for driving the pump using part of the fluid removed.

BACKGROUND OF THE INVENTION

In the oil industry, down hole pumps, usually driven from the surface, are used to remove hydrocarbon-based fluid from the well.

There are basically two types of mechanically actuated submersible pumps presently being used in the oil industry: tubing pumps and rod pumps. The operating principal is the same for both, although they differ somewhat in construction and application. Both are positive displacement type pumps. They consist of a cylindrical barrel in which a hollow plunger and a standing (inlet) valve and a travel (exhaust) valve within the plunger; and raise the crude oil from below the ground to the surface. The force necessary to move the plunger is transferred from the surface pumping unit through a string of sucker rods to the pump which is set into the producing formation at or near the bottom of the hole.

A tubing pump is an integral part of the tubing string. The pump barrel serves as a section of tubing. The plunger and traveling valve are run in the well with the sucker rods. The standing valve can be one of two types, either fixed or retrievable. The fixed type is attached below the pump barrel as part of the tubing string. The retrievable type standing valve rests in a cup-type or mechanical-type seating nipple at the bottom of the tubing string. This type can be removed with the sucker rod string by means of a valve puller which is permanently attached to the lower end of the plunger.

Tubing pumps are regarded as high volume, heavy duty pumps. Maximum production can be expected with this type in relation to size of the tubing. However, because of the large plunger diameter, the fluid load will be greater than with a rod pump. Therefore, depending on the rod strength and size of surface pumping equipment, the depth at which the tubing pump can be run is limited.

When barrel repairs are required on the tubing pump, the entire tubing string must be pulled. This is a more expensive operation than a simple rod pulling job to repair and insert a rod pump.

Rod pumps are inserted inside the well tubing and run as an assembled unit with the sucker rods. Rod pumps have a cup-type or mechanical-type seating nipple which is run as part of the tubing string. A rod pump is removed from the tubing when the sucker rod string is pulled.

A rod pump is necessarily smaller in diameter than a tubing pump and, therefore, of smaller capacity for given tubing size.

The American Petroleum Institute (API) classifies pump by size, and by rod or tubing type pumps. In addition, pumps are classified as either heavy wall or thin wall pumps. Pumps may be either metal to metal pumps, or soft type pumps. Metal to metal pumps are made with a precision-honed barrel and a metal plunger. The tolerance between the barrel and the plunger (plunger clearance) can be specified to achieve the greatest volume metric efficiency and the longest possible pump life under given well conditions.

Steel, brass and monel barrels are available plain or chrome-plated interior diameters to reduce friction and improve pump life. Hardened steel, to help overcome medium to severe abrasion, is also available. Steel plungers can be spray coated with wear-resistant alloy materials to help reduce corrosion and wear.

Soft-packed pumps seal the barrel to plunger with cups, rings or repacks, or combination of these. Soft-packed pumps are generally not recommended for use below 5,000 feet because the fluid load in deeper wells.

Typical rod and tubing pumps currently used in the oil industry may be found in the Dover Corporations Norris O'Bannon Pump Catalog, P.O. Box 2070, Tulsa, OK 74101. This catalog also contains an illustration and explanation of how a subsurface pump works.

A typical hydraulically actuated subsurface pump unit comprises a single-acting pump powered by a hydraulic motor, with the hydraulic motor receiving its motor force from high pressure oil pumped down the well to the motor. In general, the hydraulic motor comprises a differential area piston having its smaller end continuously exposed to high pressure power drive fluid and a main valve in the piston for controlling the flow of power fluid to the larger end of the piston, while the piston is reciprocating within the cylinder. The main valve is in turn controlled by a pilot valve, with the pilot valve usually being carried in the piston and mechanically shifted by the piston to open one or more ports which, in turn, hydraulically shift the main valve.

Kobe Hydraulic oil well pumping systems manufactures a double acting, double cylinder-double piston down hole hydraulically (water or oil) driven pump. This pump may be used in open or closed power fluid systems and comes in a variety of piston sizes to meet all depth and volume requirements, but requires high operating pressures and high r.p.m.'s to drive the pump. Further, the Kobe pump uses lube oil as the hydraulic fluid and not a portion of the formation fluid.

A number of patents disclose a double-piston and double-cylinder pump driven by hydraulic fluid.

U.S. Pat. No. 2,366,777 (Farley 1945) discloses a hydraulic pump with two pistons connected by a common connecting rod. Each piston reciprocates in its own cylinder. The pump uses fluid pressure to drive sucker rods. Compared with the present invention, Farley's drive piston is raised and lowered by drive fluid pressure that exhausts the drive fluid only on the upstroke. In addition, the valving arrangement is different.

U.S. Pat. No. 2,631,541 (Dempsey 1953) also discloses a pump which is fluid actuated and has a double-piston, single connecting rod structure. The reciprocating drive piston contains a pilot valve to channel the high pressure drive fluid therethrough. Input supply pressure is constantly maintained on one face of the drive piston and exhaust pressure relief is regulated on the opposite face causing the movement of piston in one direction. It diverts spent power fluid through the connecting rod by means of valving in the piston. The Dempsey pump alternates a working stroke with a non-working stroke.

U.S. Pat. No. 2,943,567 (English 1960) discloses yet another double-piston common connecting rod arrangement. The English pump uses side inlet and outlet ports and contains a valve in piston unit that transfers the drive fluid through the piston and the hollow connecting rod and to the working plunger.

U.S. Pat. No. 3,093,122 (Sachnik 1963) discloses a reciprocating-type piston pump using pressurized fluid to drive the piston. A master slide valve controls the distribution of the pressurized fluid to a power piston that is connected to a piston rod, also common to the fluid pump piston. A pilot slide valve operable upon movement of the common piston rod controls the operation of the master slide valve.

However, none of the prior art pumps disclose the unique valving of the present invention, which eliminates the need for a valve in piston, hollow connecting rods or slide valves. Nor do they disclose a high volume, long stroke, hydraulically driven pump capable of operating at relatively low pressures, and low r.p.m.'s.

The present methods for removing fluids from subsurface producing formations use down hole pumps that are either mechanically activated by sucker rods, are hydraulic drive or are electrically driven (such as Recter pumps). However, those hydraulically driven pumps known in the art require high pressures (over 1000 p.s.i.) which accelerates pump wear and escalates costs.

SUMMARY OF THE INVENTION

It is the object of this invention to provide for a hydraulically driven down hole pump for raising formation fluids to the surface.

It is a further object of this invention to provide for a piston-driven down hole pump that lifts formation fluids on both the downstroke and the upstroke of the pump piston.

It is a further object of this invention to provide for a hydraulically-driven pump that uses a portion of the formation fluid as a drive fluid.

It is the further object of this invention to provide for a down hole pump using water which has separated out of the formation fluid as a drive fluid.

It is a further object of this invention to provide for a down hole pump driven by drive fluid whose pressure source is a surface-mounted water injection pump.

It is a further object of this invention to provide for a down hole piston-driven pump that contains a power piston and pump piston each operating in its own cylinder and connected by a common connecting rod.

It is a further object of this invention to provide a cycling valve that allows drive fluid to act on the upper surface of the power piston during the downstroke and when the power piston reaches the downstroke to divert the drive fluid around the power cylinder to the underside of the power piston thereby raising the power piston and contemporaneously venting the drive fluid trapped above the power piston into the produced fluids in the well annulus.

It is a further object of this invention to provide for a cycling valve that will prevent the pump from stalling.

It is a further object of this invention for a hydraulically actuated down hole pump with a long connecting rod and capable of operating at relatively low pressures and at low r.p.m.'s, thereby increasing the pump's useful life.

It is a further object of this invention to provide for a valve arrangement in the pump cylinder that allows formation fluids to be injected into the well annulus from the top of the pump cylinder when the pump piston is on the upstroke, contemporaneously drawing in formation fluid in the pump cylinder beneath the pump piston and, when the pump piston is on the downstroke, injecting the formation fluid below the pump piston into the well annulus while contemporaneously drawing formation fluid into the top of the pump cylinder above the pump piston, thus pumping formation fluid into well annulus on both the upstroke and downstroke of the pump piston.

It is a further object of this invention to provide for a diverting flue adjacent to the pump cylinder to carry formation fluids through a packer to the top of the pump cylinder.

It is a further object of this invention to provide for a rod stem extending axially through the top of the power cylinder from the power piston that may be used to actuate the cycling valve at the top of the power cylinder.

It is a further object of this invention to provide for a method of using a down hole pump for removing formation fluid from the ground and using a disposable part of the formation fluid reinjected to drive a down hole pump.

DESCRIPTION OF THE PREFERRED EMBODIMENT

Figure 1:
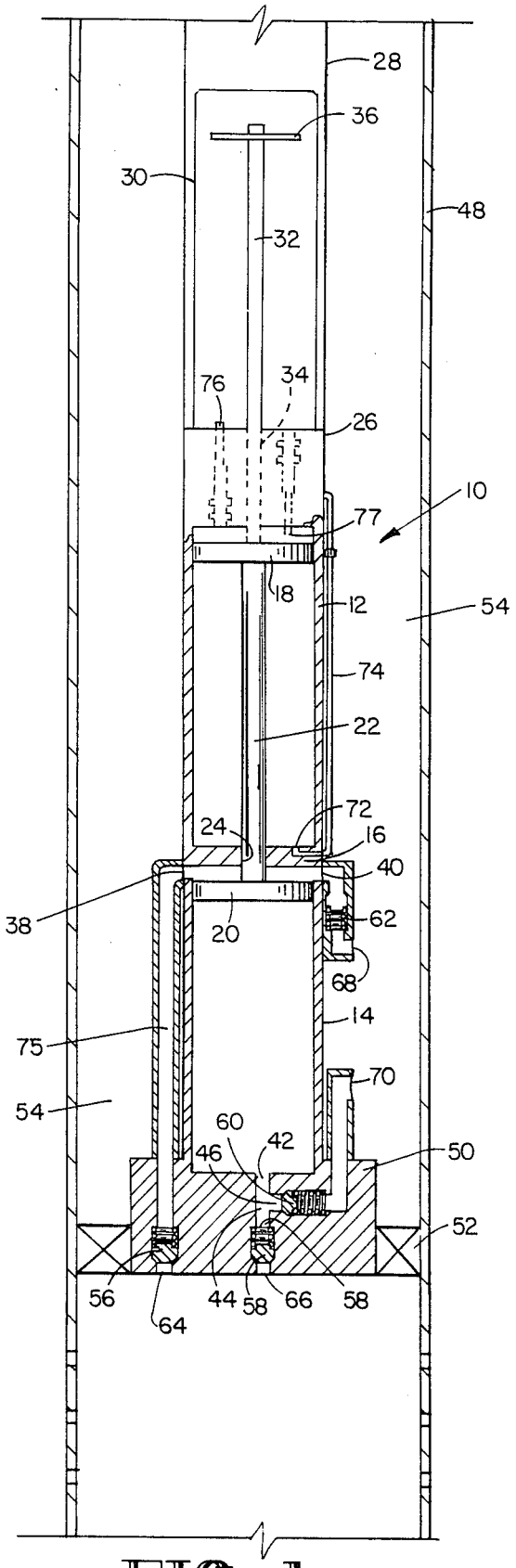
FIG. 1 is a cross-sectional view of the pump, omitting details of the cycling valve.

FIG. 1 illustrates a cross-sectional view of pump 10. Pump 10 consists of two cylinders, power cylinder 12 and pump cylinder 14. The bottom end of power cylinder 12 and the top end of pump cylinder 14 meet at plate 16. The longitudinal axis of the two cylinders 12, 14 coincide so that they are in an "opposed" configuration.

Reciprocating within power cylinder 12 is power piston 18. Reciprocating within pump cylinder 14 is pump piston 20. These two pistons 18, 20 are connected by connecting rod 22. Because pistons 18, 20 are connected by a common connecting rod 22, they have equal length stroke. Further, when power piston 18 reaches the top of its upstroke, so does pump piston 20. When power piston 18 reaches the bottom of its downward stroke, so does pump piston 20.

Pump 10 can be constructed with a variety of stroke lengths as dictated by the amount of formation fluid to be removed from the well. Because of the unique design of the pump, long connecting rods 22 may be used and low piston 18 and 20 speeds realized.

Connecting rod 22 passes through plate 16 through plate bore 24. Bushings or other appropriate seals (not shown) seal power cylinder 12 from pump cylinder 14 where connecting rod 22 passes through plate bore 24, to limit any seepage of fluid or any other loss of compression between cylinders 12, 14.

The top end of power cylinder 12 contains cycling valve 26. Construction and operational detail of cycling valve 26 will be explained more fully below in conjunction with FIGS. 2 and 3. Drive fluid line 28 is sealed to the top of cycling valve 26 and provides communication therefrom to the surface-mounted injection pump 216 when pump 10 is operating down hole. Drive fluid line 28 is constructed of 2⅜" or 2⅞" steel tubing and carries under pressure a drive fluid, preferably water, between injection pump 216 and pump 10. Drive fluid line 28 is sealed so it will not leak. Filter screen 30 is located in drive fluid line 28 between injection pump 216 and cycling valve 26 to remove any grit or particles in drive fluid.

Striker rod 32 extends upward from the top face of power piston 18 along the longitudinal axis of power cylinder 12, through the center of cycling valve 26 and into drive fluid line 28. Cycling valve assembly bore 34 contains bushings or other suitable seals to insure that striker rod 32 slides freely therethrough, and minimizing any compression loss or leakage between drive fluid line 28 and power cylinder 12. Striker plate 36 is attached to the end of striker rod 32 in a manner such that the plane of striker plate 36 is perpendicular to the longitudinal axis of striker rod 32. As power piston 18 reciprocates in power cylinder 12, striker rod 32 simultaneously rises and falls. The cross-sectional area of striker rod 32 is substantially identical to the cross-sectional area of connecting rod 22. Therefore, there is an equal volume of drive fluid filling power cylinder 12 when power piston 18 is at the top of its upstroke as when power piston 18 is at the bottom of its downstroke.

The top end of pump cylinder 14 contains top end intake port 38 and top end exhaust port 40. The bottom end of pump cylinder 14 contains intake/exhaust port 42, bottom end intake port 44, and bottom end exhaust port 46. Alternately combined intake/exhaust port 42 may be a separate intake port (in communication with bottom end intake vent 66) and a separate exhaust port (in communication with bottom end exhaust vent 70).

At the bottom end of pump cylinder 14 is pump cylinder head 50. Pump 10 is inserted down hole, beneath the level of the producing formation, and packer 52 is used to seal pump cylinder head 50 to casing 48. Packer 52 is preferably a tension type but may be of the cup or mechanical type and seals pump 10 to casing 48, preventing formation fluid from seeping into annulus 54.

Pump cylinder head 50 contains three ball check valves 56, 58 and 60. The top end of pump cylinder 14 contains ball check valve 62. The ball check valves 56, 58, 60 and 62 allow the passage of formation fluid in only a single direction. Ball check valve 56 allows the passage of formation fluids from top end intake vent 64 to top end intake port 38. Ball check valve 58 allows the passage of formation fluids from bottom end intake vent 66 to intake/exhaust port 42. Ball check valve 60 limits the passage of formation fluids from intake/exhaust port 42 to bottom end exhaust vent 70. Ball check valve 62 restricts the flow of formation fluids from top end exhaust port 40 to top end exhaust vent 68. Alternatively, any one-way valves could be substituted for ball check valves 56, 58, 60 and 62 as illustrated.

Located in the bottom end of pump cylinder head 50 and in communication with the formation fluid are top end intake vent 64 and bottom end intake vent 66. Formation fluid that is lifted to the surface will pass into and through pump 10 through either vent 64 or 66. Produced fluid is expelled from pump cylinder 14 into annulus 54 through either top end exhaust vent 68 or bottom end exhaust vent 70 to begin its rise to the surface.

OPERATION OF PUMP

Pump 10 is inserted into a well cased with casing 48. Casing 48 generally comes in 4½",5½", 7", and 7⅝" diameters and is usually made from steel of industry grade and weight or other suitable material. The well is cased through the fluid producing formation, such casing 48 containing perforations therethrough to allow the formation fluid to penetrate and flood casing 48. The natural hydrostatic and geostatic pressure on the formation fluid forces it to migrate into the well.

Power piston 18 supplies the energy required for pump piston 20 to raise produced fluid collected in annulus 54 to the surface. Pump 10 may operate at pressures as low as 400 p.s.i. and as high as 5,000 p.s.i. The amount of formation fluid that operator desires to raise to the surface determines the amount of pressure to be delivered to pump 10 through drive line 28. An advantage of using lower pressure is decreased wear on pump parts. At the surface, produced fluid is separated by separator 200 into its immissible components. In most cases, these components are crude oil and water. Separator 200 allows the two liquids to stand and mechanically separate into crude oil and water. On the surface injection pump 216 injects into drive fluid line 28 an appropriate drive fluid, usually the water from separator 200 (see FIG. 1A).

Pressure is transmitted through drive fluid line 28 to cycling valve 26. Cycling valve 26 allows passage of drive fluid therethrough and into the top end of power cylinder 12 when power piston 18 reaches the top of its upstroke. Drive fluid passing through cycling valve 26 urges power piston 18 downward. At the same time power piston 18 is urged downward, drive fluid trapped beneath power piston 18 is forced into bypass port 72 through bypass line 74 into cycling valve 26 where it is injected into annulus 54 and comingles with formation fluid to rise to the surface therewith as produced fluid. As power piston 18 reaches the bottom of its downstroke, striker plate 36 trips cycling valve 26 by contacting poppet valve 76. This diverts the flow of drive fluid from injection into the top of power cylinder 12 to injection into bypass line 74 and through bypass port 72. The drive fluid then urges underside of power piston 18 upward.

Simultaneous with the diversion of drive fluid into the bottom end of power cylinder 12 is a switch (more fully set forth below) in cycling valve 26 to allow drive fluid trapped in power cylinder 12 above power piston 18 to be vented into annulus 54 as drive fluid pours through the bottom of bypass port 72 into power cylinder 12 and urges power piston 18 upward.

In this manner, the drive fluid diverted through cycling valve 26, alternately urges power piston 18 first downward, then upward, and continually expels spent drive fluid into annulus 54 to mix with formation fluid to rise to the surface as produced fluid. At the surface, the produced fluid is separated into formation fluid and drive fluid; and the drive fluid is, in part, reinjected into drive fluid line 28 to operate pump 10, as set forth in detail below (see FIG. 1A). In this manner, injection of drive fluid from the surface reciprocates power piston 18.

The reciprocating motion of pump piston 20 in pump cylinder 14 continuously removes formation fluid through either top end intake vent 64 or bottom end intake vent 66 and ejects it into annulus 54 through either top end exhaust vent 68 or bottom end exhaust vent 70.

When pump piston 20 begins its downward stroke, formation fluid is vacuum drawn in through top end intake vent 64, ball check valve 56, diverting flue 75 and into pump cylinder 14 at top end intake port 38. At the same time, formation fluid trapped beneath pump piston 20 is forced through intake/exhaust port 42 through ball check valve 60 and into annulus 54 through bottom end exhaust vent 70.

On the upstroke of pump piston 20, formation fluid that has been drawn in through top end intake port 38 during the downstroke is expelled into annulus 54 through top end exhaust port 40, ball check valve 62, and top end exhaust vent 68. At the same time, rising pump piston 20 creates a vacuum in pump cylinder 14 beneath pump piston 20 and therefore draws formation fluid through bottom end intake vent 66, ball check valve 48, and intake/exhaust port 42.

In this manner, pump piston 20 is "double acting." That is, both upstroke and downstroke of pump piston 20 are working strokes, both strokes lifting formation fluid from beneath seal created by packer 52 and injecting it into annulus 54 where it will rise to surface and drawn off at casinghead 202 as produced fluid.

OPERATION OF CYCLING VALVE ASSEMBLY

Figure 2:
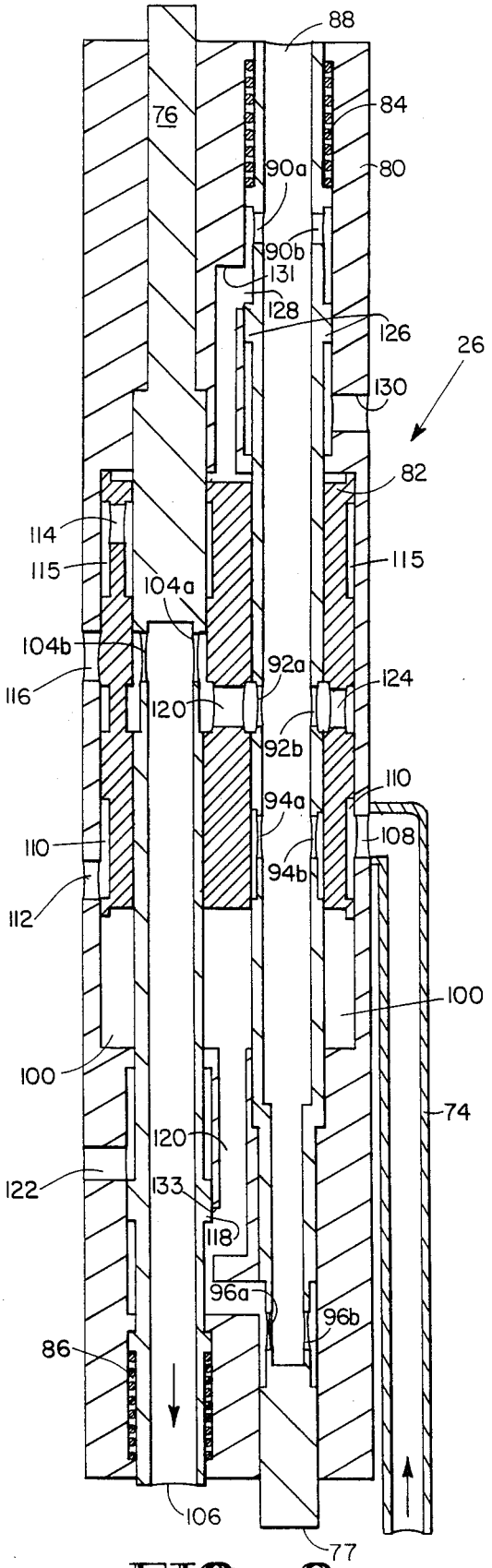
FIG. 2 is a cross-sectional view of the cycling valve during the downstroke of the power piston.
Figure 3:
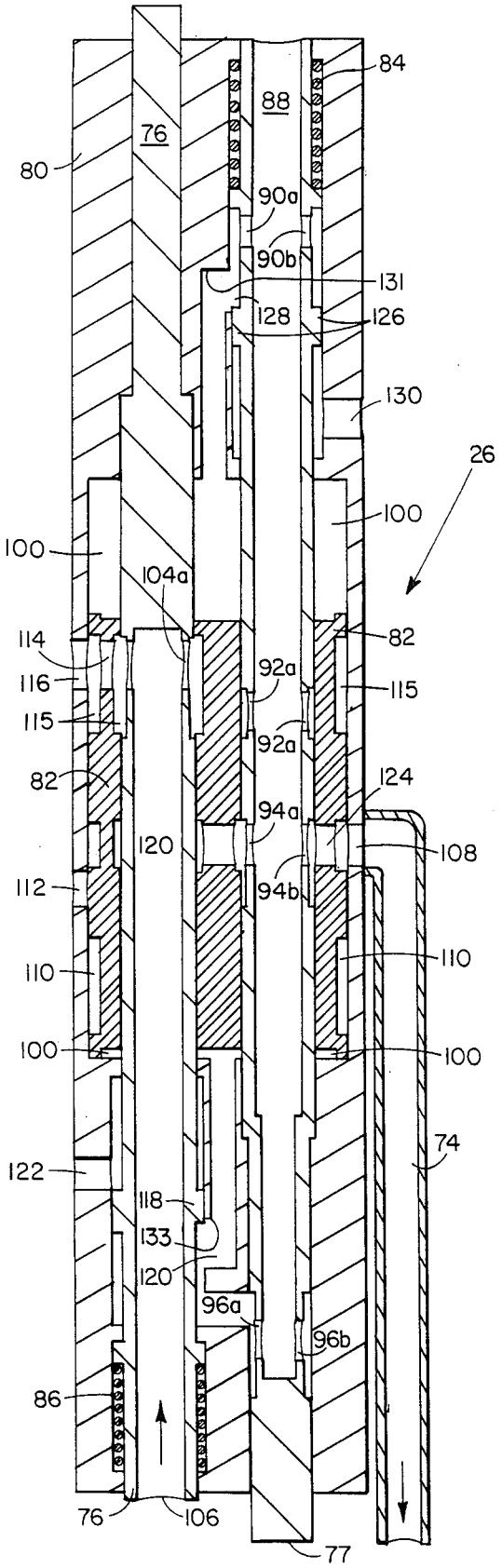
FIG. 3 is a cross-sectional view of the cycling valve during the upstroke of the power piston.

FIGS. 2 and 3 illustrate the components and operation of cycling valve 26. Cycling valve 26 is sized to fit on the top end of power cylinder 12, and to seal it. Therefore, in the preferred embodiment, cycling valve 26 is generally circular in shape. FIGS. 2 and 3 illustrate two different modes of cycling valve 26.

FIG. 2 (downstroke) illustrates the position of cycling valve 26 during the downstroke of power piston 18, during which drive fluid is flowing through cycling valve 26 and into the top end of power cylinder 12. Simultaneously, drive fluid is flowing out bypass port 72, into bypass line 74, through cycling valve 26 and into annulus 54.

FIG. 3 illustrates the position of the components of cycling valve 26 when power piston 18 is on the upstroke. In this position, drive fluid passes from drive fluid line 28, through cycling valve 26 and into bypass line 74. Here the drive fluid is injected through bypass port 72 into the bottom end of power cylinder 12 to urge power piston 18 upward. The drive fluid located on the top side of power piston 18 is vented through cycling valve 26 into annulus 54.

As illustrated in FIGS. 2 and 3, cycling valve 26 is comprised primarily of three main parts: valve body 80, which is fixedly attached to the top end of power cylinder 12; valve spool 82, surrounding poppet valves 76, 77 and slidably contained within valve body 80 and poppet valves 76, 77 sized and shaped to fit slidably within valve body 80.

As can be seen in FIGS. 2 and 3, valve spool 82 contains a number of orifices or ports therein, and can slide up and down within valve body 80. Further, valve spool 82 encloses substantially hollow poppet valves 76, 77 which are sized and shaped to slide up and down within valve spool 82. Valve body 80, poppet valves 76, 77, and valve spool 82 all contain a number of orifices or ports therethrough, the overall function of which is to permit the flow of drive fluid through cycling valve 26, as set forth more fully below.

Figure 4:
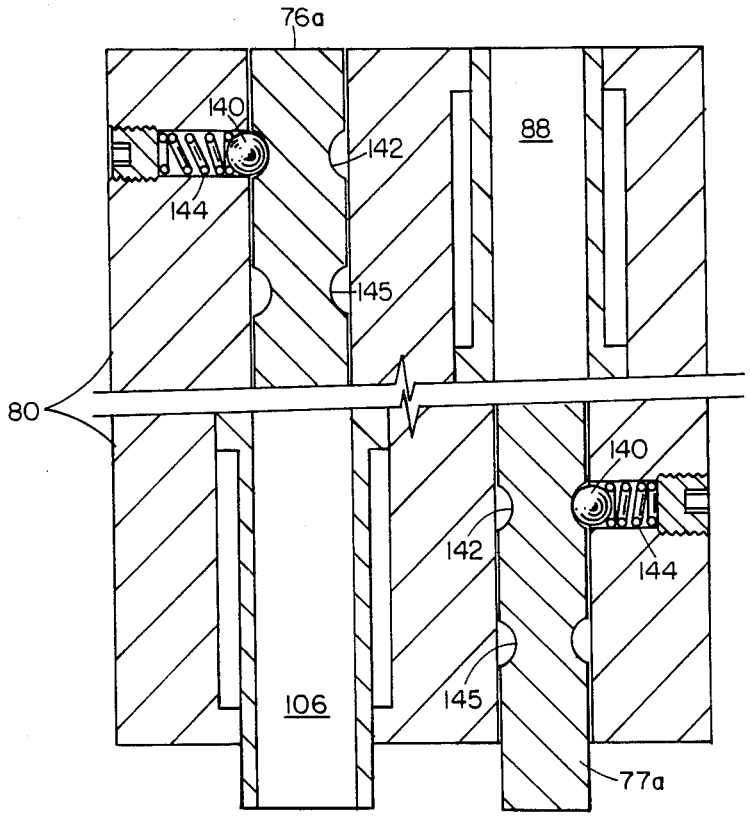
FIG. 4 is a cross-sectional view of the positively detained poppet valves.

Poppet valve 77, in the alternate embodiment, is spring-loaded by poppet valve spring 84 and biased in a "down" position such that the bottom end of poppet valve 77 extends slightly into the top end of power cylinder 12 as illustrated in FIGS. 2 and 3. Poppet valve 76, on the other hand, is spring-loaded, in the atlernate embodiment, by poppet valve spring 86 and biased in an "up" position such that the top end of poppet valve 76 extends slightly above the top surface of valve body 80 and into drive fluid line 28. FIG. 4, discussed in more detail below, sets for the preferred positvely detained valves 76 and 77. Striker plate 36 is located above cycling valve 26 and is sized to contact poppet valve 76 on the bottom end of the downstroke of power piston 18. In a similar manner, the bottom end of poppet valve 77 will contact power piston 18 as power piston 18 reaches the top of its upstroke.

FIG. 2 illustrates the relative positions of valve spool 82, and poppet valves 76 and 77 during the downstroke of power piston 18. In this position, poppet valves 76 and 77 extend into drive fluid line 28 and the top end of power cylinder 12, respectively. During operation of pump 10, drive fluid, through drive fluid line 28, exerts constant pressure on the top end of cycling valve 26 through the action of injection pump 216, located preferably on the surface of the ground (see FIG. 1A). Poppet valve 77 has hollow end 88 open to drive fluid line 28. This allows the drive fluid to enter poppet valve 77.

There are four pairs of ports through the walls of poppet valve 77. Those ports are designated: **90*a*, 90*b*; 92*a*, 92*b*; 94*a*, 94*b*; 96*a*, 96*b*. When power piston 18 is moving on its downward stroke, valve spool 82 is at the top of valve spool channel 100 and abutting valve body 80. Drive fluid flows through hollow end 88, through poppet valve ports 92*a* and 92*b*, through valve spool port 102, and through ports 104*a* and 104*b* of poppet valve 76 and into the top end of power cylinder 12 through hollow end 106**.

Poppet valve ports **94*a* and 94*b* are sealed by the lower end of valve spool 82. However, the drive fluid is in communication with both the top end and bottom end of valve spool 82. That is, in this position (downward stroke of power piston 18), drive fluid passes through poppet valve ports 90*a* and 90*b* and exerts pressure downward on the top surface of valve spool 82. Likewise, when cycling valve 26 is in a position as illustrated in FIG. 2, drive fluid entering hollow end 88 passes through poppet valve ports 96*a* and 96*b* and exerts pressure upward on the bottom surface of valve spool 82. This hydrostatic pressure is from the same source, namely drive fluid line 28, and the pressure urging the top of valve spool 82 downward and the pressure urging the bottom of valve spool 82 upward is equal. This hydrostatic pressure being equal in magnitude and opposite in direction, fixes or holds valve spool 82 in place, until the end of the downward stroke of power piston 18. At this point, striker plate 36 contacts extended end of poppet valve 76**, disrupting the pressure equilibrium in a manner more fully set forth below.

The downward stroke of power piston 18 (FIG. 2) forces the drive fluid from a region beneath power piston 18 out bottom end of power cylinder 12 through bypass port 72 and u bypass line 74 into valve body port 108. This drive fluid then passes around valve spool 82 at pocket 110 and is exhausted into annulus 54 through valve body exhaust port 112. In summary, while drive fluid is forcing power piston 18 downward, the drive fluid beneath power piston 18 is being expelled into annulus 54.

FIG. 3 (upstroke) illustrates the position of poppet valves 76 and 77 and spool 82 when power piston 18 is on the upward stroke. In this position, valve spool 82 is in the lower end of valve spool channel 100 abutting valve body 80. Drive fluid pressure in drive fluid line 28 at the top surface of cycling valve 26 causes the drive fluid to enter poppet valve 77 through hollow end 88. The drive fluid then flows through ports 94*a* and 94*b* and valve body port 108 into bypass line 74. From that point, it continues into the bottom end of power cylinder 12 through bypass port 72 and forces power piston 18 upward.

During the upstroke of power piston 18, drive fluid is in communication with the top surface of valve spool 82 through ports 90*a* and 90*b*. This drive fluid urges valve spool 82 downward. At the same time, drive fluid is in communication with the bottom surface of valve spool 82 through ports 96*a* and 96*b* and urges of valve spool 82 upward. These hydrostatic pressures are equal and in opposite directions; therefore, they negate each other and create an equilibrium which holds valve spool 82 in place until extended end of poppet valve 77 is struck by the top side of power piston 18 as power piston 18 reaches the top of its upstroke.

At the same time the drive fluid is urging power piston 18 upward, drive fluid trapped above power piston 18 as it rises is forced into hollow end 106 of poppet valve 76 and through ports 104*a* and 104*b*, through valve spool port 114 and into annulus 54 through valve body exhaust port 116. This spent drive fluid will then rise through annulus 54 to the surface intermingled with formation fluid to form produced fluid.

Striker plate 36 on the downstroke of power piston 18, contacts extended end of poppet valve 76 on the upstroke of power piston 18 the top surface thereof strikes the extended end of poppet valve 77. These two actions disrupt the hydrostatic equilibrium on valve spool 82, resulting in a shift of valve spool 82 from one end of valve spool channel 100 to the other. This shift results in the diversion of drive fluid through cycling valve 26 in the manner set out above. This disruption of equilibrium and subsequent shift is fully set out as follows.

As power piston 18 approaches the bottom end of its downward stroke, striker plate 36 contacts poppet valve 76. This causes poppet valve 76 to move downward against poppet valve spring 86. Land 118, as part of a wall of poppel valve 76, will then slide downward and first seal chamber 120 from poppet valve 77, and maintain pressure of the drive fluid therein against the bottom surface of valve spool 82. As land 118 passes lip 133, it opens chamber 120 to valve body exhaust port 122. Pressure at valve body exhaust port 122 is lower than pressure in drive fluid line 28, which pressure is still being exerted at the top surface of valve spool 82, and the imbalance created causes valve spool 82 to slide to the bottom end of valve spool channel 100. During this movement of valve spool 82, drive fluid from drive fluid line 28 remains in communication with power piston 18, through hollow end 88 of poppet valve 77, ports 92*a*, 102 and 104*a*, 104*b* and hollow end 106, urging it downward. Offset of ports 104*a* and 104*b* allows the continued flow of drive fluid through cycling valve 26 and into the top end of power cylinder 12 as poppet valve 76 is being depressed. This continued flow insures the bottoming of power piston 18 in its downward stroke. As valve spool 82 shifts downward in valve spool channel 100, ports 92*a* and 92*b* are blocked and ports 104*a* and 104*b*, 114 and 116 are connected. Fluid still remaining in poppet valve 77 is ported through 94*a* and 94*b*, spool port 124 and valve body port 108 into bypass line 74.

Valve body exhaust port 112 is offset from valve body port 106 to prevent drive fluid at port 124 from venting out of valve body exhaust port 112 when spool 82 shifts down (see FIG. 3). Offset 110 is incorporated to connect valve body port 108 to port 112 when spool 82 is up thereby exhausting drive fluid from bottom end of power piston. With valve spool 82 shifted down and striker plate 36 momentarily holding poppet valve 76 down, ports 104*a* and 104*b* will be positioned at bottom end of offset 115. When striker plate 36 moves up and poppet valve spring 86 repositions poppet valve 76, ports 104*a* and 104*b* will realign with port 114 as illustrated in FIG. 3.

As power piston 18 moves up, under impetus of drive fluid and poppet valve spring 86, striker plate 36 moves away from poppet valve 76, whose poppet valve spring 86 urges it to return to the up position, extending poppet valve 76 into drive fluid line 28. This return reconnects chamber 120 to ports 96*a* and 96*b* and through hollow end 88 of poppet valve 77 to drive fluid line 28. This repositioning also repressurizes chamber 120, rebalancing valve spool 82 at the bottom end of valve spool channel 100. In this manner, striker plate 36 contacting poppet valve 76 unbalances valve spool 82, causing it to reposition.

A repositioning of valve spool 82 from the bottom end to the top end of valve spool channel 100 results when power piston 18 reaches the top of its upstroke and contacts extended end of poppet valve 77. When this occurs, poppet valve 77 moves upward, compressing poppet valve spring 84. This movement causes land 126 to first seal chamber 12 from drive fluid pressure as land 126 contacts lip 131. As land 126 passes lip 131, chamber 128 is open to exhaust port 130, allowing drive fluid trapped above valve spool 82 in chamber 128 to escape through exhaust port 130 into annulus 54 to comingle with the formation fluid. The opening of chamber 128 to exhaust port 130 cuts off the hydrostatic pressure used to maintain valve spool 28 in its position at the bottom of valve spool channel 100. That is, even as poppet valve 77 is depressed, drive fluid line 28 and the drive fluid therein is in communication with the bottom end of valve spool 82 through hollow end 88, poppet valve 77, ports 96*a* and ports 96*b* and chamber 120, creating an imbalance which causes valve spool 82 to slide upward involving spool channel 100 to abut valve body 80. Offset of ports 94*a* and 94*b* allows continued communication between drive fluid and power piston 18 forcing the latter to rise to its top most position. When valve spool 82 slides upward, valve spool port 102, ports 92*a* and 92*b*, and ports 104*a* and 104*b* are then connected, starting the cycle over, and forcing power piston 18 downward.

In summary, depression of poppet valves 76 and 77 by striker plate 36 and power piston 18, respectively, cause valve spool 82 to shift its position from one end of valve spool channel 100 to the other end. This shift causes diversion of drive fluid through cycling valve 26, changing the force on power piston 18 between the downstroke and upstroke.

FIG. 4 illustrates the preferred embodiment of cycling valve 26 wherein valves 76*a* and 77*a* are positively retained in an up or a down position, rather than being biased by poppet valve springs 84 and 86. In this preferred embodiment, balls 140 are urged against positively detained valves 76a and 77a, and dimensioned to fit grooves 142 therein. Balls 140 are biased by ball springs 144.

In operation, when power piston 20 reaches the end of its downward stroke, striker plate 36 contacts extended end of positively detained valve 76a and open end of positively detained valve 77a, which both extend into drive fluid line 28. That is, in this preferred embodiment, using positively detained valves 76a and 77a, both positively detained valves 76a and 77a will be extending into drive fluid line 28 when power piston 18 is on its downward stroke. As striker plate 36 contacts extended ends of positively detained valves 76a and 77a, it will depress both of them, unseating ball 140 from lower grooves 145 and reseating balls 140 into upper groove 142. This position is illustrated in FIG. 4.

On the other hand, when power piston 18 is on its upward stroke, power piston 18 will contact both extended ends of positively detained valves 76a and 77a as they extend into the top end of power piston 12. When this occurs, balls 140 will be unseated from their positions in upper groove 142 and reseat into lower grooves 145.

The use of positively detained valves 76a and 77a in the manner set forth above "locks" spool 82 in an "up" position in spool channel 100 because both positively detained valves 76a and 77a are extending into drive fluid line 28 and therefore land 126 seals chamber 128 during the downstroke of power piston 18. On the other hand, during the upstroke of power piston 18, land 118 seals chamber 120 "locking" spool 82 in a "down" position in spool channel 100. That is, when spool 82 is in an "up" position, there is no drive fluid exerting a downward force on it; and in the "down" position there is no drive fluid exerting an upward force on it as is the case when poppet valves 76 and 77 are used.

The advantage of this embodiment is that it prevents stalling of the pump which occurs when the pump is not in use and power piston 18 drifts downward under its own weight.

Figure 1A:
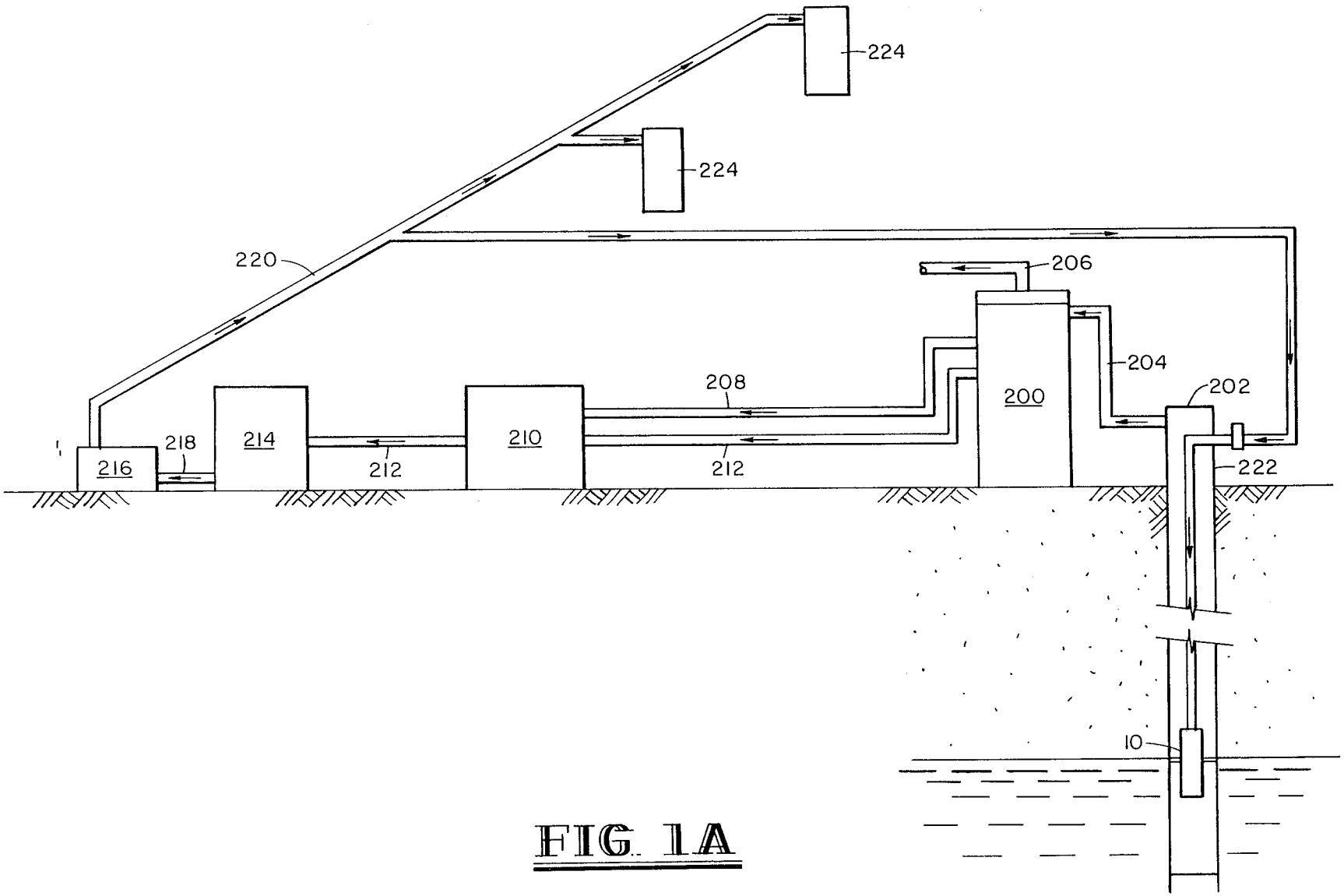
FIG. 1*a* is a cross-sectional perspective illustrating the method and environment in which the pump operates.

FIG. 1A illustrates the environment in which pump 10, or any other hydraulically-driven down hole pump may be used, when the hydraulic drive fluid is part of the fluid produced from the formation. Separator 200 receives produced fluid from casinghead 202 through feed line 204. In separator 200, such as those known in the art, the produced fluid is separated into a hydrocarbon component and a primarily water component. Gas outlet 206 vents hydrocarbon gas to a storage tank or commercial pipeline or merely vents it to the atmosphere. Oil leg 208 takes the liquid hydrocarbon from the hydrocarbon component of the produced fluid from separator 200 to oil tank 210. Water leg 212 takes water from separator 200 to water tank 214. Injection pump 216 draws water from water tank 214 through water draw line 218. Injection pump 216, through high pressure discharge line 220, reinjects a portion of the water into producing well(s) 222 to drive pump(s) 10 and also a portion into injection (disposal) wells 224.

Thus, it can be seen that injection pumps 216, which are known in the art, may be used for the novel function of driving down hole pump 10, with part of the produced fluid.

Although the invention has been described in connection with the preferred embodiment, it is not intended to limit the invention to the particular form set forth; but on the contrary, it is intended to cover such alternatives, modifications and equivalents as may be included within the spirit and scope of the invention as defined by the appended claims.

We claim:

1. A hydraulically-driven down hole pump for lifting formation fluids from a formation comprising:

a pump cylinder having a top end and a bottom end;

a power cylinder having a top end and a bottom end;

a power piston located in and sized to fit snugly within said power cylinder;

a pump piston located in and sized to fit snugly within said pump cylinder for lifting formation fluids;

a connecting rod connecting said power piston to said pump piston;

a drive fluid line for feeding a drive fluid from a pressure source to said power cylinder, the drive fluid providing the force for moving said power piston, wherein said drive fluid line is connected to the top end of a cycling valve, and said cycling valve is connected to the top end of said power cylinder;

said cycling valve on said power cylinder for reciprocating said pistons between a first injecting step wherein the drive fluid is injected into the top end of said power cylinder when said power piston has completed the upward stroke to force said power piston downward while simultaneously allowing the drive fluid beneath said power piston to escape therefrom into an outer annulus and a second injecting step wherein the drive fluid is injected into the bottom end of said power cylinder when said power piston has completed the downward stroke to force said power piston upward while simultaneously allowing the drive fluid above said power piston to escape therefrom into the outer annulus;

wherein said cycling valve further comprises:

means for carrying the drive fluid from said drive fluid line to the top end of said power cylinder during the first injecting step of said cycling valve and from said drive fluid line to the bottom end of said power cylinder during the second injecting step of said cycling valve, wherein said carrying means further includes:

a first poppet valve, said first poppet valve being substantially hollow and having walls defining two sets of ports, said first poppet valve having a first end substantially open to the drive fluid source and a second end, the second end being closed and extending into the power cylinder; and a second poppet valve, said second poppet valve being substantially hollow and having walls defining a port, said second poppet valve having a first end substantially open to the top end of the power cylinder and with a second end, the second end being closed and extending into the drive fluid source; means for diverting the drive fluid between the first injecting step and the second injecting step wherein said diverting means includes:

a spool with walls, the walls defining a multiplicity of ports and further defining channels, said spool sized to slidably contain a portion of each of said poppet valves and capable of engaging in a first position a first set of the ports of said first poppet valve with the port of said second poppet valve through a first port of the multiplicity of ports of said spool for a first injecting of the drive fluid into the top end of the cylinder, while further capable of simultaneously directing fluid removed from the bottom end of the cylinder through the channels and around said diverting means and said carrying means and in a second position for engaging a second set of ports of said first poppet valve with a second port of the multiplicity of ports of said spool for a second injecting of the drive fluid into the bottom of the cylinder, while allowing the drive fluid expelled from the top end of the cylinder to enter said second poppet valve and pass therethrough to an exterior of the pump through the port of said second poppet valve and through a third port of the multiplicity of ports of said spool;

a valve body with walls defining ports, said ports adapted to allow the passage of the drive fluid therethrough, said valve body sized to contain said diverting means and said carrying means; and trip means connected to said power piston for alternating said cycling valve between the first injecting step and the second injecting step; second injecting step.

wherein said trip means activates said diverting means causing said cycling valve to reciprocate between the first injecting step and the second injecting step.

2. A hydraulically-driven down hole pump for lifting formation fluids from a formation comprising:

a pump cylinder having a top end and a bottom end;

a power cylinder having a top end and a bottom end;

a power piston located in and sized to fit snugly within said power cylinder;

a pump piston located in and sized to fit snugly within said pump cylinder for lifting formation fluids;

a connecting rod connecting said power piston to said pump piston; a drive fluid line for feeding a drive fluid from a pressure source to said power cylinder, the drive fluid providing the force for moving said power piston, wherein said drive fluid line is connected to the top end of a cycling valve, and said cycling valve is connected to the top end of said power cylinder;

said cycling valve on said power cylinder for reciprocating said pistons between a first injecting step wherein the drive fluid is injected into the top end of said power cylinder when said power piston has completed the upward stroke to force said power piston downward while simultaneously allowing the drive fluid beneath said power piston to escape therefrom into an outer annulus; and a second injecting step wherein the drive fluid is injected into the bottom end of said power cylinder when said power piston has completed the downward stroke to force said power piston upward while simultaneously allowing the drive fluid above said power piston to escape therefrom into the outer annulus;

wherein said cycling valve further comprises:

a first poppet valve, said first poppet valve being substantially hollow, and with walls defining a multiplicity of ports, said first poppet valve having a substantially open first end in communication with said drive fluid line and a substantially solid second end, with the second end of said first poppet valve extending into the top end of said power cylinder;

a second poppet valve, said second poppet valve being substantially hollow, and with walls defining a multiplicity of ports in a wall thereof, said second poppet valve having a substantially open first end in communication with the top end of said power cylinder and a substantially solid second end, with the second end of said first poppet valve extending into said drive fluid line;

spool means comprised of walls containing a plurality of ports, said spool means substantially enclosing and slidably engaging said poppet valves, said spool means for engaging and disengaging the ports of said poppet valves, thereby reciprocating said cycling valve between the first injecting step and the second injecting step;

a valve body with walls containing ports and defining a cavity, the cavity shaped to slidably contain said spool means and said poppet valves; and wherein said spool means, when located at a first position within said valve body engages some of the ports of said poppet valves, said spool means and said valve body to permit the first injecting step and when located at a second position within said valve body, engages others of the ports of said poppet valves, said spool means and said valve body to permit the second injecting step.

3. The device as described in claim 2 above wherein the top end of said pump cylinder is attached to the bottom end of said power cylinder so the longitudinal axis of said pump cylinder and the longitudinal axis of said power cylinder coincide.

4. The device as described in claim 2 above including a pump valve assembly, wherein said pump valve assembly includes:

a top end intake port at the top end of said pump cylinder for drawing the formation fluid into the top end of said pump cylinder;

a top end exhaust port at the top end of said pump cylinder expelling the formation fluid from top end of said pump cylinder;

a bottom end intake port at the bottom end of said pump cylinder for drawing the formation fluid into the bottom end of said pump cylinder; and a bottom end exhaust port at the bottom end of said pump cylinder for expelling the formation fluid from the bottom end of said pump cylinder;

wherein said pump valve assembly drawing formation fluid into said pump cylinder through one of said intake ports at one end of said pump cylinder while simultaneously exhausting the formation fluid from said pump cylinder through one of said exhaust ports at the other end of said pump cylinder, into the outer annulus.

5. The device as described in claim 4 above, said pump valve assembly further comprising:

annulus vent means for providing communication between said to end exhaust port and the outer annulus, and said bottom end exhaust port and the outer annulus; and formation vent means for providing communication between said top end intake port and the formation, and said bottom end intake port and the formation.

6. The device as described in claim 5 above, further comprising:

a first check valve between said formation vent means and said top end intake port for directionally restricting a flow from said formation vent to said top end intake port;

a second check valve between said annulus vent means and said top end exhaust port for directionally restricting a flow from said top end exhaust port to said annulus vent means;

a third check valve between said bottom end intake port and said formation vent means for directionally restricting a flow from said formation vent means to said bottom end intake port; and a fourth check valve between said bottom end exhaust port and said annulus vent means for directionally restricting a flow from said bottom end exhaust port to said annulus vent means.

7. The device as described in claim 2 above, wherein said connecting rod is sized such that said power piston is at the top end of said power cylinder when said pump piston is at the top end of said pump cylinder.

8. The device as described in claim 2 further comprising a means for screening particles from the drive fluid before the drive fluid enters said cycling valve.

9. The device as described in claim 2 above, further comprising a bypass line connected at a first end to said cycling valve and at a second end to the bottom end of said power cylinder for carrying the drive fluid between said cycling valve and the bottom end of said power cylinder.

10. The device as described in claim 2 above, further comprising means for sealing the pump against a wall casing so that formation fluid cannot enter the outer annulus without passing through said pump cylinder.

* * * * *